US005766000A

United States Patent [19]

Thompson

[11] Patent Number: 5,766,000

[45] Date of Patent: Jun. 16, 1998

[54] COMBUSTION CHAMBER

[75] Inventor: Stanley P. Thompson, Topeka, Kans.

[73] Assignee: Beloit Technologies, Inc., Beloit, Wis.

[21] Appl. No.: 476,598

[22] Filed: Jun. 6, 1995

[51] Int. Cl.[6] ..... F23M 3/00

[52] U.S. Cl. ..... 431/9; 431/157; 431/173; 431/351; 110/264

[58] Field of Search ..... 431/173, 157, 431/158, 353, 350, 351, 9; 126/99 D, 80, 110 A, 104 R, 99 C; 110/264, 104 R

[56] References Cited

U.S. PATENT DOCUMENTS

| | | | |
|---|---|---|---|
| 2,560,074 | 7/1951 | Bloomer | 110/264 |
| 2,823,628 | 2/1958 | Poole et al. | 110/264 |
| 2,985,438 | 5/1961 | Prowler | 431/157 |
| 3,048,215 | 8/1962 | Huckabee | 431/173 |
| 3,145,076 | 8/1964 | Reichert et al. | 431/9 |
| 3,804,578 | 4/1974 | Robbins | 431/173 |
| 3,861,055 | 1/1975 | Thompson . | |
| 4,120,640 | 10/1978 | Martin | 431/173 |
| 4,526,529 | 7/1985 | Bernard et al. | 431/173 |
| 4,879,959 | 11/1989 | Korenberg | 431/157 |

FOREIGN PATENT DOCUMENTS

| | | | |
|---|---|---|---|
| 1501907 | 1/1970 | Germany | 431/173 |

*Primary Examiner*—James C. Yeung
*Attorney, Agent, or Firm*—Shook, Hardy & Bacon L.L.P

[57] ABSTRACT

A combustion chamber has a vertically oriented body with an inner surface defining an inner combustion area. A burner is disposed adjacent one end of the body so that the flame of the burner when lit will extend into the combustion area. An annular insert is disposed in the combustion area and generally surrounds the flame of the burner. The annular insert defines a secondary gas introduction zone for introducing secondary gases into the combustion area so that the recycled gases can be oxidized by the burner flame. The insert has an inner surface presenting at least one opening for allowing fluid communication between the introduction zone and the combustion area. The opening is disposed tangentially to the insert inner surface to direct gases in rotational motion to define a film of gases adjacent the inner surface of the combustion chamber. The body of the chamber can include an outer shell and an inner cylindrical liner. The outer shell has a generally horizontal inwardly extending support shelf. The inner liner has an outwardly extending generally horizontal ridge positioned adjacent its upper end. The ridge rests on the shelf to support the liner in a hanging fashion so that the liner can expand and contract when subjected to temperature variations.

20 Claims, 4 Drawing Sheets

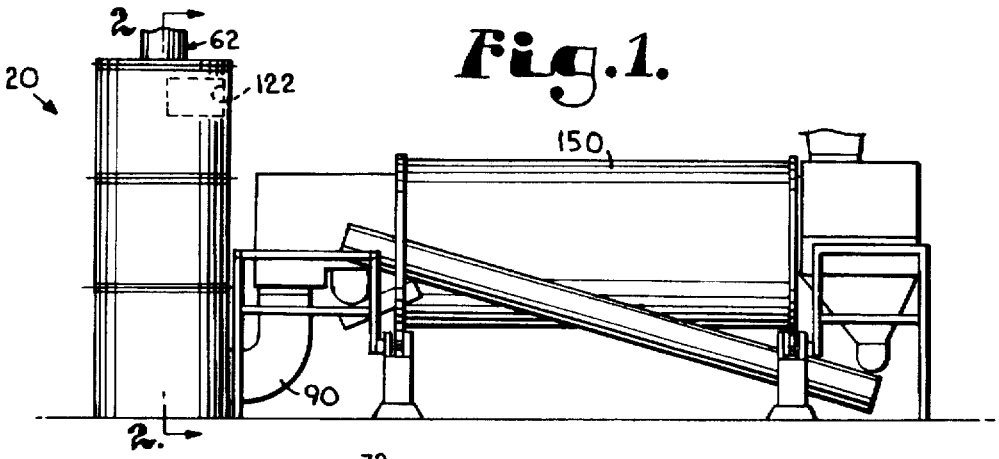
Fig.1.
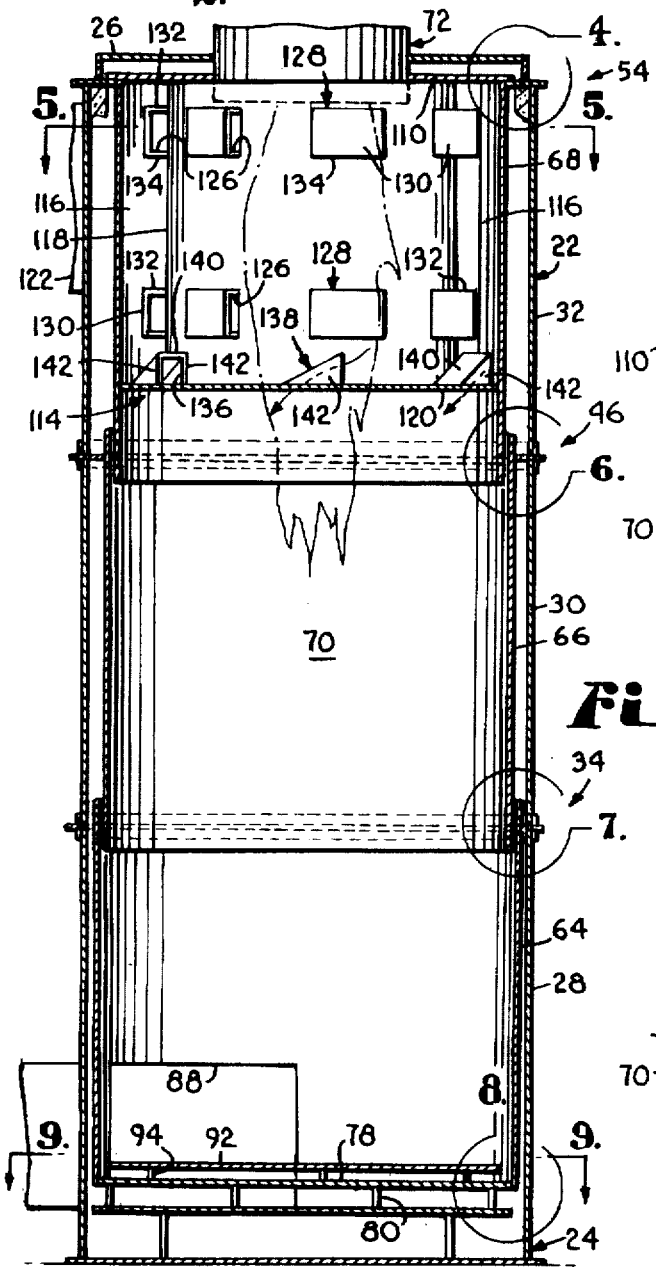
Fig.2.
Fig.4.
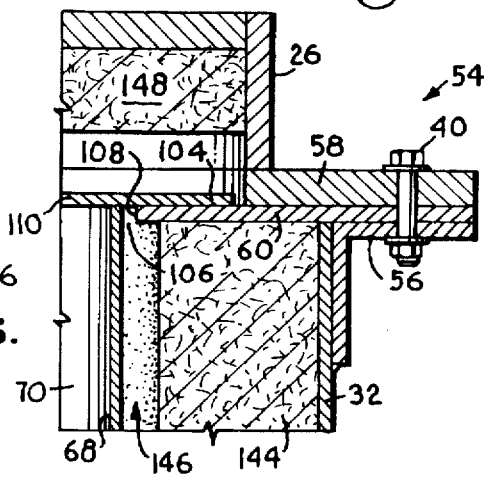
Fig.6.
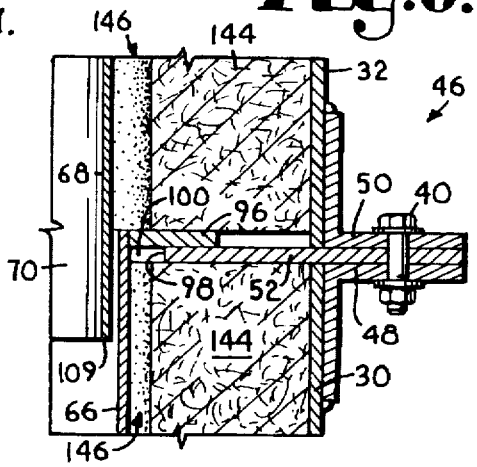

Fig. 13.
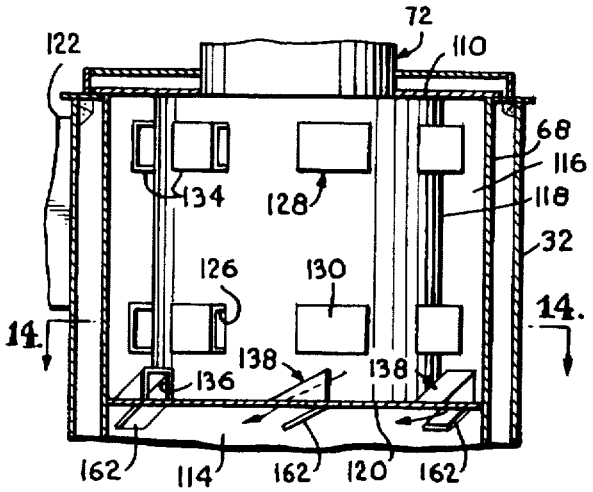
Fig. 14.
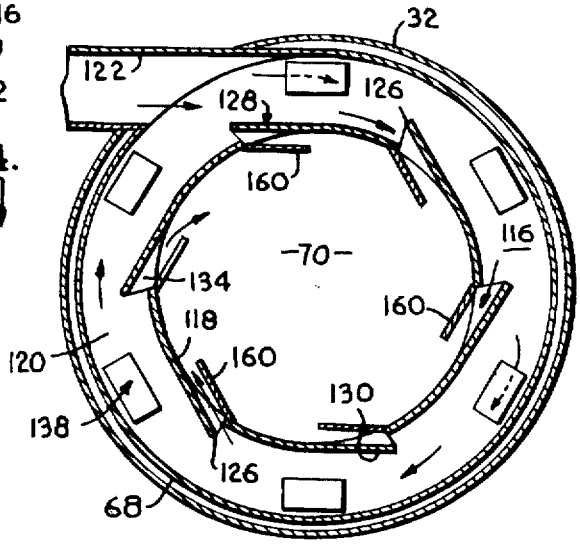
Fig. 15.
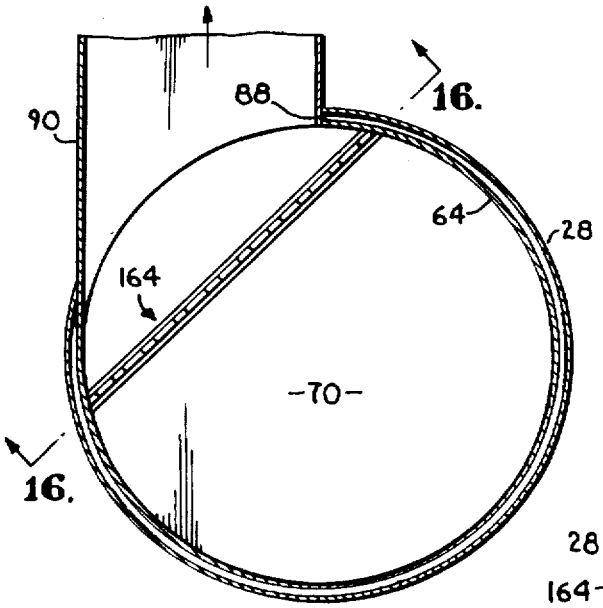
Fig. 17.
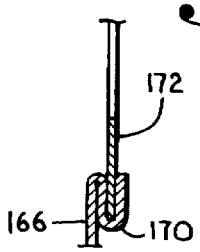
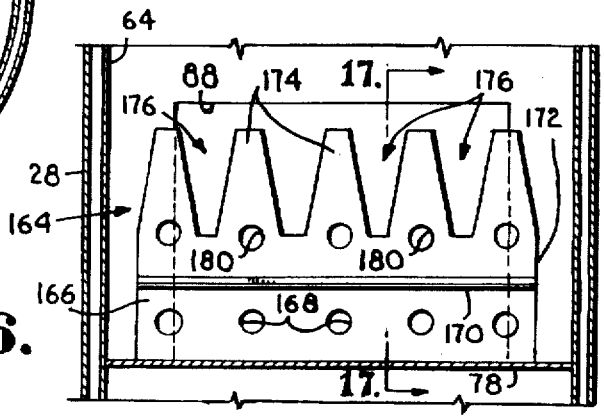
Fig. 16.

COMBUSTION CHAMBER

BACKGROUND OF THE INVENTION

This invention relates to a combustion chamber for supplying heated gases to a device in which a material is dried and/or heated.

Drying systems are important features in the manufacture and processing of many different materials. For example, drying systems are often used in drying wood chips during the manufacturing of particle board. Further, drying systems are of particular importance during the processing of ethanol. More particularly, after ethanol has been removed from grain during the fermentation process, it is then desirable to dry the grain to allow storage and resale of the grain for animal feed or other uses.

Typical drying systems include a combustion chamber into which natural gas and air are supplied and combusted. The heated combustion gasses in the combustion chamber are then induced by a draft fan into a rotating cylindrical dryer. The material to be dried is introduced into the dryer and exposed to the current of heated gasses. The dried material is then separated from the heated gas current in a cyclone separator. The remaining heated gasses are then typically vented to the environment. An example of a typical drying system of the prior art is disclosed in U.S. Pat. No. 3,861,055, which is incorporated herein by reference.

Drying systems typically use a horizontally disposed combustion chamber as disclosed in the above patent. The temperatures encountered in these combustion chambers typically are around 1200° Fahrenheit and can reach temperatures as high as 2000° Fahrenheit. In order to accommodate these high temperatures, the combustion chamber is normally made of a refractory material, for instance ceramic tile. Combustion chambers made of or lined with this refractory material typically are expensive and difficult to manufacture.

Attempts have been made to construct a horizontal combustion chamber of a suitable more cost effective material, for example stainless steel. However, stainless steel horizontal combustion chambers typically are not able to withstand the temperatures associated with the combustion process. More specifically, the stainless steel walls are subjected to intense radiation generated by the burner flame which gradually results in oxidation of the stainless steel. Because of the construction of the horizontal combustion chamber which is typically a horizontally disposed cylinder, the stainless steel walls are often required to support their own weight. Thus, as the walls are subjected to higher and higher temperatures, they may lose their structural strength and become seriously deformed or collapse under their own weight.

In some prior drying systems, attempts have been made to recycle gasses exiting the dryer back into the combustion chamber. Because the recycled gasses are often introduced into the combustion chamber in a haphazard and uncontrolled fashion, the gasses may interfere with the operation of and efficiency of the burner flame. Furthermore, the uncontrolled introduction of recycled gasses may result in incomplete and/or inconsistent oxidation of pollutants found in the recycled gasses.

Thus, a novel combustion chamber construction is needed to overcome the drawbacks and shortcomings of prior combustion chambers.

SUMMARY OF THE INVENTION

One object of the present invention is to provide a combustion chamber construction which allows the oxidation of recycled gases with greater efficiency while reducing the burner flame interference cause by recycled gases.

Another object of the present invention is to provide a combustion chamber construction which utilizes recycled combustion gases to absorb thermal energy emitted by the burner flame to protect and insulate the chamber structure from such thermal energy.

A further object of the present invention is to provide a combustion chamber construction which is able to expand and contract when subjected to temperature variations.

A still further object of the present invention is to provide a combustion chamber construction for a drying system which allows the use of stainless steel as the constructing material.

The present invention is directed to a combustion chamber having a vertically oriented body with an inner surface defining an inner combustion area. A burner is disposed adjacent one end of the body so that the flame of the burner when lit will extend into the combustion area. An annular insert is disposed in the combustion area and generally surrounds the flame of the burner. The annular insert defines a secondary gas introduction zone for introducing secondary gases into the combustion area so that the secondary gases can be oxidized by the burner flame. The insert has an inner surface presenting at least one opening for allowing fluid communication between the introduction zone and the combustion area. The opening is disposed tangentially to the insert inner surface to direct secondary gases in a rotational motion to define a film of gases adjacent the inner surface of the combustion chamber. The body of the chamber can include an outer shell and a inner cylindrical liner. The outer shell has a generally horizontal inwardly extending support shelf. The inner liner has an outwardly extending generally horizontal ridge positioned adjacent its upper end. The ridge rests on the shelf to support the liner in a hanging fashion so that the liner can expand and contract when subjected to temperature variations.

Additional objects, advantages, and novel features of the invention will be set forth in part in the description which follows and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification:

FIG. 1 is a diagrammatic view of a drying system utilizing a combustion chamber embodying the principles of the present invention;

FIG. 2 is a detailed cross-sectional view taken generally along line 2—2 of FIG. 1, parts being broken away and shown in cross-section to reveal details of construction;

FIG. 4 is a fragmentary enlarged view of the area designated by the numeral 4 in FIG. 2 and showing the hanging arrangement of the upper liner section;

FIG. 6 is a fragmentary enlarged view of the area designated by the numeral 6 in FIG. 2 and showing the hanging arrangement of the intermediate liner section;

FIG. 13 is a fragmentary view similar to FIG. 1 but showing the annular recycled gas introduction insert with optional directional baffles;

FIG. 14 is a detailed cross-sectional view taken generally along line 14—14 of FIG. 13 and showing the positioning of the directional baffles on the recycled gas introduction insert;

FIG. 15 is a view similar to FIG. 12, but showing the optional temperature distribution plate disposed across the outlet port;

FIG. 16 is a fragmentary enlarged detailed cross-sectional view taken generally along line 16—16 of FIG. 15; and FIG. 17 is a fragmentary enlarged detailed cross-sectional view taken generally along line 17—17 of FIG. 16 and showing the connecting arrangement between the lower and upper sections of the temperature distribution plate.

DETAILED DESCRIPTION OF PREFERRED EMBODIMENTS

Figure 3:
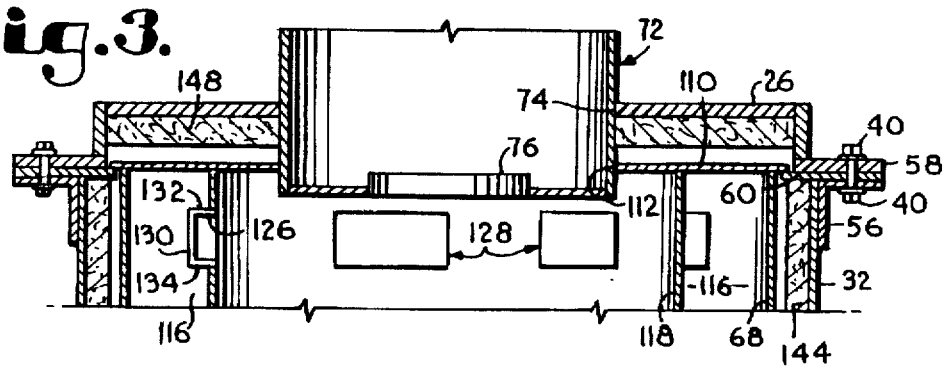
FIG. 3 is a fragmentary enlarged view similar to FIG. 1 showing the upper end of the combustion chamber.

A combustion chamber embodying the principles of this invention is broadly designated in the drawings by the reference numeral 20. Chamber 20 has an outer cylindrical shell 22 with a circular base 24 and a circular cover 26 as shown in FIG. 2. Shell 22 is comprised of a lower cylindrical wall section 28, an intermediate cylindrical wall section 30, and an upper cylindrical wall section 32.

Figure 7:
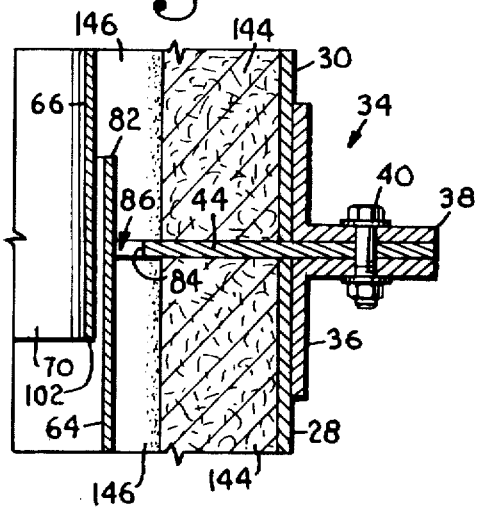
FIG. 7 is a fragmentary enlarged view of the area designated by the numeral 7 in FIG. 2 and showing the relative positions of the intermediate liner section and the lower liner section.
Figure 8:
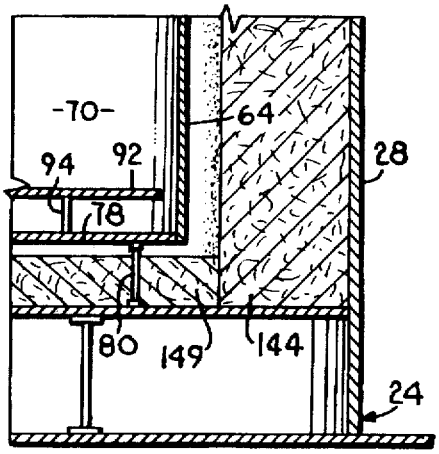
FIG. 8 is a fragmentary enlarged view of the area designated by the numeral 8 in FIG. 2.

Lower section 28 is preferably formed integrally with base 24 and extends upwardly from the base's periphery as best shown in FIG. 8. Lower section 28 is connected to intermediate section 30 by a connecting arrangement 34 as best shown in FIG. 7. Arrangement 34 includes a pair of annular L-shaped connecting flanges 36 and 38. Flange 36 is preferably welded to the outer peripheral surface of section 28 adjacent its upper end. Flange 38 is preferably welded to the outer peripheral surface of intermediate section 30 adjacent its lower end. The horizontal portions of flanges 36 and 38 preferably have a plurality of aligned spaced apart apertures for receiving bolts 40 to secure the two sections together.

Arrangement 34 also serves to support an abutment ring 44. Ring 44 helps to maintain the alignment of and preserve the shape of an adjacent liner section as will be further described below. Ring 44 preferably is formed of a flat annular piece of metal. Ring 44 is supported at its vertical location by positioning or "sandwiching" an outer portion of the ring between the horizontal portions of flanges 36 and 38. Ring 44 can have apertures that align with the apertures in flanges 36 and 38 so that bolts 40 secure the sections together and secure the ring at its vertical location.

Intermediate section 30 is connected to upper section 32 by connecting arrangement 46 as best shown in FIG. 6. Arrangement 46 has annular L-shaped connecting flanges 48 and 50 which are identical to flanges 36 and 38 described above. Flange 48 is welded to the peripheral surface of intermediate section 30 adjacent its upper end. Flange 50 is welded to upper section 32 adjacent its lower end. Flanges 48 and 50 are connected by bolts 40 in the same manner as flanges 36 and 38 described above. Arrangement 46 is used to secure an annular support shelf 52 at a vertical location within shell 22. Shelf 52 is used to support an intermediate lining section, as will be more fully described below. Shelf 52 preferably is formed of a flat annular piece of metal. As with ring 46, shelf 52 is secured at its vertical location by positioning or "sandwiching" an outer portion of the shelf between the horizontal portions of flanges 48 and 50. Further, shelf 52 is held in place by aligning apertures formed in the shelf with the apertures of flanges 48 and 50 and securing bolts 40 in the aligned apertures.

Cover 26 is secured to upper section 32 by a connecting arrangement 54 as best shown in FIGS. 3 and 4. Connecting arrangement 54 includes an annular L-shaped connecting flange 56, identical to flanges 36, 38, 48 and 50 which is welded to the peripheral surface of upper section 32 adjacent its upper end. Cover 26 has an annular connecting portion 58. The horizontal portion of flange 56 and connecting portion 58 are connected together by aligning a plurality of spaced apart apertures formed in both structures and disposing bolts 40 through the aligned apertures. Further, as with connecting arrangement 46, arrangement 54 serves to secure annular support shelf 60 at its vertical location. Shelf 60 is used to support an upper liner section, as will be more fully described below. As with shelf 52, shelf 60 preferably is made of a flat annular piece of metal. An outer portion of shelf 60 is positioned or "sandwiched" between the horizontal portion of flange 56 and connecting portion 58. As with shelf 52, shelf 60 can have a plurality of apertures which align with the apertures in flange 56 and portion 58 so that bolts 40 can be used to secure shelf 60 at its vertical position.

Shell base 24, shell sections 28, 30 and 32, connecting flanges 36, 38, 48, 50 and 56; cover 26, ring 44; and support shelves 52 and 60 are all preferably made of carbon steel.

A lower hollow cylindrical liner 64, an intermediate hollow cylindrical liner 66, and an upper hollow cylindrical liner 68 are concentrically received inside of outer shell 22 and form a combustion area 70 in their interiors as shown in FIG. 2. A burner 72 is attached to the upper surface of cover 26. Burner 72 is connected to an air blower (not shown) and a burner fuel inlet duct (not shown). Burner 72 extends through hole 74 in cover 26 so that the burner outlet 76 is at least partially disposed in combustion area 70 as shown in FIG. 3.

Lower liner section 64 is generally cup-shaped and completely sealed along its lower end. Liner section 64 has a circular floor 78 which rests on supports 80 of base 24 as shown in FIGS. 2 and 8. The cylindrical side wall of liner 64 extends upwardly from floor 78 to a position adjacent abutment ring 44 as best shown in FIG. 7. More specifically, the outer peripheral surface of liner 64 adjacent its upper end 82 is spaced inwardly from inner edge 84 of abutment ring 44 so that an annular space 86 is formed between the liner and edge 84. Abutment ring 44 maintains alignment of and reduces outward bowing of liner section 64 when the liner is subject to the elevated temperatures associated with combustion area 70.

Figure 9:
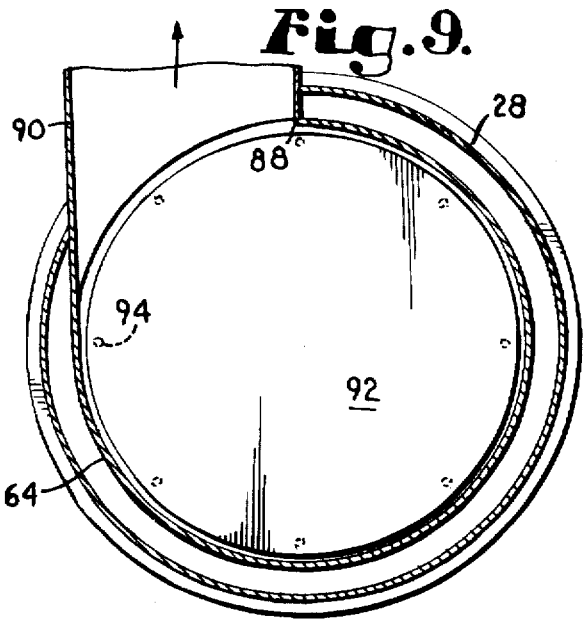
FIG. 9 is a enlarged detailed cross-sectional view taken generally along line 9—9 of FIG. 2 and showing the combustion chamber outlet port.

Liner section 64 has generally rectangular outlet port 88 formed on a portion of its sidewall as shown in FIGS. 2 and 9. Outlet port 88 allows fluid communication between dryer inlet duct 90 and combustion area 70 so that gasses within the combustion area can be conveyed from area 70 through duct 90 and into the dryer, as will be more fully described below. Duct 90 extends through an opening in the side wall of lower shell section 28 to achieve its connection with outlet port 88.

Liner section 64 further can have a removable bottom protector plate 92 as shown in FIGS. 2 and 8. Plate 92 sets on braces 94 extending upwardly from floor 78. This lower portion of combustion area 70 is subject to intense radiation from the burner flame, and thus, is the area most likely to suffer thermal damage. Plate 92 generally covers floor 78 and is removable to allow easy replacement of the portion of the liner section most likely to suffer thermal damage.

Intermediate liner section 66 is supported or hung from support shelf 52 as best shown in FIG. 6. More specifically, the upper end of liner section 66 has an outwardly extending annular ridge 96 disposed adjacent its upper end. The lower surface of ridge 96 rests on the upper surface of shelf 52 to support liner section 66 in a hanging fashion. Further, the outer peripheral surface of liner section 66 adjacent ridge 96 is spaced from inner edge 98 of shelf 52 so that an annular gap 100 is formed between shelf 52 and the outer peripheral surface of the liner. Because of the provision of this gap and because the ridge 96 is simply resting on shelf 52 and not rigidly secured thereto, liner section 66 can freely expand outwardly when subjected to the elevated temperatures within the combustion area. More specifically, liner 66 will tend to expand laterally when the combustion chamber reaches elevated temperatures for extended periods of time. As this happens, ridge 96 simply slides outwardly along shelf 52. The liner can expand outwardly until the outer peripheral surface of the liner engages inner edge 98 of the shelf 52. Thus, edge 98 maintains the alignment of liner section 66 and reduces outward bowing of the liner section so that the generally circular shape thereof is maintained.

The lower end 102 of the liner section 66 is concentrically positioned within the upper end 82 of liner section 64 as shown in FIG. 7. Liner section 64 and liner section 66 are not however attached or secured to one another in any way. Thus, when elevated temperatures exist in combustion area 70, intermediate liner section 66 is free to expand downwardly. Further, lower liner section 64 is free to expand upwardly. Additionally, because of gap 86 between liner section 64 and edge 84 of abutment ring 44, liner section 64 can also expand outwardly until it engages edge 84. Further, the outer peripheral surface of section 66 and the inner surface of section 64 are slightly spaced from one another so that when elevated temperatures exist in the combustion area the surfaces will engage to form a seal that reduces heat leakage from the combustion area.

Upper liner section 68 is solely supported by or hung from shelf 60 as best shown in FIG. 4. More specifically, liner section 68 has an annular ridge 104 extending outwardly from its upper end. The lower surface of ridge 104 rests on the upper surface of shelf 60 to support the liner in a hanging fashion. An annular gap 106 is also provided between the outer peripheral surface of liner 68 adjacent ridge 104 and an inner edge 108 of shelf 60. Because of the provision of gap 106 and because ridge 104 is not fixedly secured to shelf 60 but only resting thereupon, liner section 68 is able to expand outwardly when subjected to the elevated temperatures within the combustion area. More specifically, as the temperature increases, ridge 104 can slide outwardly along shelf 60 until the outer peripheral surface of liner 68 engages edge 108. Thus, edge 108 serves to maintain the alignment of liner 68 and reduces outward bowing of the liner so that the generally circular shape thereof is maintained.

The lower end 109 of liner section 68 is concentrically positioned within the upper end of liner section 66 as shown in FIG. 6. Liner section 66 and liner section 68 are not attached or secured to one another in any way. Thus, upper liner section 68 is free to expand downwardly when subjected to elevated temperatures. Additionally, the outer peripheral surface of section 68 and the inner surface of section 66 are slightly spaced from one another so that when elevated temperatures exist in the combustion area, the surfaces will engage to form a seal that reduces heat leakage from the combustion area.

Upper liner section 68 further has a circular lid portion 110 extending inwardly from its upper edge to cover the upper end of the liner as best shown in FIGS. 3 and 4. Lid 110 has a hole 112 for receiving the lower end of burner 72 so that the burner outlet 76 can be disposed in area 70.

Figure 5:
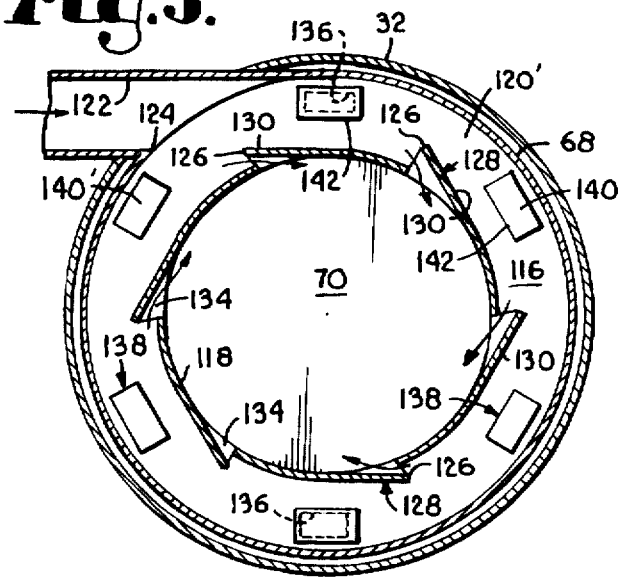
FIG. 5 is a detailed cross-sectional view taken generally along line 5—5 of FIG. 2 and showing the annular recycled gas introduction insert and the recycled gas introduction ports.

Upper liner section 68 has an annular insert 114 disposed in its interior to form an annular recycled gas introduction zone 116 as best shown in FIGS. 2, 3 and 5. More specifically, insert 114 has inner cylindrical wall 118 spaced from and concentrically received in liner section 68. Wall 118 is attached on its upper end to lid portion 110 and extends downwardly therefrom. Insert 114 also has an annular lower plate 120 which is attached at its outer edge to liner section 68 and at its inner edge to wall 118. Thus, zone 116 is bounded by liner 68, cylindrical wall 118, annular plate 120, and lid 110. Zone 116 completely encircles the burner flame (shown in phantom lines in FIG. 2) extending downwardly into combustion area 70 from burner 72. Zone 116 is in fluid communication with a recycled gas duct 122 via an inlet port 124. Duct 122 extends through an opening in upper section 32 of the outer shell 22 to connect with port 124 as best shown in FIG. 5. Duct 122 is used to supply recycled gases to the combustion chamber after the gases have been separated from dried material, as will be more fully explained below.

Wall 118 of insert 114 has a plurality of spaced apart generally rectangular openings 126 which allow fluid communication between zone 116 and the combustion area 70 as shown in FIGS. 2, 3 and 5. Openings 126 are defined by ports 128 extending into zone 116 from wall 118. Each port 128 has a directional plate 130 that extends into zone 116 from wall 118 and is generally tangential to wall 118 as best shown in FIG. 5. Each port also has a generally triangular upper plate 132 extending from the upper edge of plate 130 to wall 118 and a generally triangular lower plate 134 extending from the lower edge of plate 130 to wall 118. Thus, each opening 126 is defined by plates 130, 132 and 134 so that the opening is generally tangential to wall 118. Openings 126 formed by ports 128 allow recycled gases in zone 116 to be introduced into combustion area 70 in such a manner so that the gases are directed generally tangentially to wall 118 and form a rotating film along wall 118 that extends and flows downwardly as depicted by the arrows in FIG. 5. This rotational film surrounds the burner flame.

Lower plate 120 of insert 114 also has a plurality of spaced apart generally rectangular openings 136. Openings 136 on plate 120 are formed by ports 138 extending upwardly from plate 120 into zone 116. Each port 138 includes a generally rectangular plate 140 extending upwardly from lower plate 120 and a pair of triangular side plates 142.

In addition to recycled gases entering area 70 through openings 126, recycled gases also enter area 70 through openings 136 as depicted by the arrows in FIG. 2. More specifically, because the openings 136 are spaced around annular plate 120, gases will exit through the openings and into area 70 to form a rotational film along the inner surfaces of liner sections 64, 66 and 68. Ports 138 direct the gases downwardly. The rotational film of recycled gases exiting openings 126 join with the film formed by the recycled gases exiting openings 136 so that a continuous rotational film of recycled gases exists generally from the top of the combustion chamber downwardly to the top edge of outlet port 88 and surrounding the burner flame.

Liner sections 64, 66 and 68; ridges 96 and 104; insert 114; and ports 128 and 138 are all preferably made of stainless steel. However, these structures could also be made of other suitable heat resistant metals. Although sections 64, 66 and 68 are described above and depicted in the figures as having a cylindrical shape, they can also be made in any other suitable shape, for example a conical or an elliptical shape. Further, although annular insert 114 is depicted in the figures as having a cylindrical shape, it also can be made in any other suitable shape, for example a conical or elliptical shape.

Each shell section 28, 30 and 32 has an annular insulation layer 144 extending inwardly from its inner surface as best shown in FIGS. 3, 4, 6, 7 and 8. Each layer 144 is spaced from the outer surface of its respective liner section by an annular gap 146. Gaps 146 allow liner sections 64, 66 and 68 room to expand outwardly when subjected to the heat of the burner flame. Cover 26 also has an insulation layer 148 disposed between the inner surface of the cover and the upper surface of lid portion 110 as best shown in FIGS. 3 and 4. Layer 148 generally surrounds burner 72. A lower insulation layer 149 is disposed below floor 78 and above base 24, as shown in FIG. 8. Insulation layers 144, 148 and 149 are preferably made of a ceramic wool type insulation.

In operation, burner 72 is lit to produce a flame within combustion area 70 as shown in FIG. 2. Gases from combustion area 70 are conveyed to a rotary dryer 150 via inlet duct 90 as shown in FIG. 1. Within dryer 150 the stream of heated gases coming from the combustion chamber is exposed to the material to be dried. Thereafter, the dried material and the combustion gases from the combustion chamber are separated from one another by, for instance, a cyclone separator (not shown) . At least a portion of the separated combustion gases can then be conveyed back to the combustion chamber via recycled gas inlet duct 122.

As gases are conveyed via duct 122 into zone 116, the gases will swirl within insert 114 and will eventually exit zone 116 and enter combustion area 70 through openings 126 and 136. The recycled gases exiting these openings form a swirling film around the burner flame which coats or wipes the inner surface of wall 118 and the inner surface of liner sections 64, 66 and 68.

This swirling film of recycled gases along with the unique hanging structure of the liners 66 and 68 allows the use of a less expensive and more easily manufactured material, stainless steel, as the construction material for the combustion chamber. More specifically, the swirling film of recycled gases adjacent the inner surface of the liner sections absorbs a great deal of the radiant energy being emitted by the burner flame. The recycled gases typically have a high water vapor content and a high carbon dioxide content and, thus, are very opaque. Therefore, a substantial amount of the radiation emitted by the burner flame will be absorbed by the swirling film and will not pass through to the inner surface of the liner sections. Further, the wiping of the inner surface of the liners with the recycled gases enhances heat transfer between the liner sections and the gas film. Hence, at least a portion of the thermal energy found in the liners may be dissipated to the recycled gas film stream.

As is apparent, it is highly advantageous to have the film of recycled gases absorb as much thermal energy as possible to ensure that pollutants found in the recycled gases are oxidized, thus reducing the emission of such pollutants to the environment. Therefore, the provision of the swirling film of recycled gases serves a dual function in that it absorbs thermal energy that would normally pass to the liner sections, and further by absorbing this energy, pollutants found within the recycled gases are oxidized.

Because the recycled gases are introduced into combustion area 70 adjacent to the base of the burner flame and surrounding the burner flame, the possibility of interference with the burner flame is reduced. Furthermore, most burner flames have a natural rotation. That is, the flame burns generally in a clockwise or counterclockwise rotation. It has been found to be advantageous to introduce the swirling stream of recycled gases into the combustion area so that they rotate in the same direction as the natural rotation of the burner flame. Although the gases introduced into insert 114 by duct 122 have been described above as recycled gases, the gases introduced into these structures to form the swirling film can be any type of secondary gases from any source. That is, secondary gases can include recycled gases from the drying system itself or any other gases from any other systems.

The unique structures of liner sections 64, 66 and 68 also allow the use of stainless steel as the material of manufacture. More specifically, as the temperature within combustion area 70 rises, liner sections 66 and 68 can easily expand in the longitudinal direction due to their hanging configuration and their unsupported lower edges. Further, connecting arrangements 46 and 54 also allow lateral expansion of the liners because of the provision of ridges 96 and 104 being able to slide outwardly along support shelves 52 and 60 respectively. Liner sections 66 and 68 can laterally expand until they engage the edges 98 and 108 of shelves 52 and 60 respectively. Thus, edges 98 and 108 serve to maintain alignment of and prevent outward bowing of the liner sections. Gaps 146 between the outer surface of the liner sections and the inner surface of the insulation layer 144 also allow for this lateral expansion.

It has been found that the outer cylindrical wall of lower liner section 64 is not subjected to the intense thermal energy that liner sections 66 and 68 are subjected to. Therefore, liner section 64 need not be supported in a hanging fashion. However, the upper edge of liner section 64 is unrestricted and can expand upwardly. Furthermore, the outer wall of liner section 64 is free to expand outwardly, but is limited in its outward expansion by abutment ring 44. Ring 44 serves to maintain alignment of and prevent outward bowing of the liner sections. One area of liner section 64 that is subjected to a great amount of thermal energy from radiation is its floor 78. Thus, it may be desirable to provide the replaceable expendable absorption plate 92 above floor 78. Plate 92 can simply be replaced after it has suffered a sufficient amount of thermal damage.

This unique support arrangement of the liner sections within the outer shell allows the use of stainless steel in combustion chambers at elevated temperatures where it was previously not possible to do so. More specifically, a combustion chamber constructed as described herein could accommodate temperatures that approach 2000° Fahrenheit within its combustion area. Horizontal stainless steel combustion chambers of the prior art typically would collapse or would become severely deformed under their own weight when subjected to such temperatures.

Figure 10:
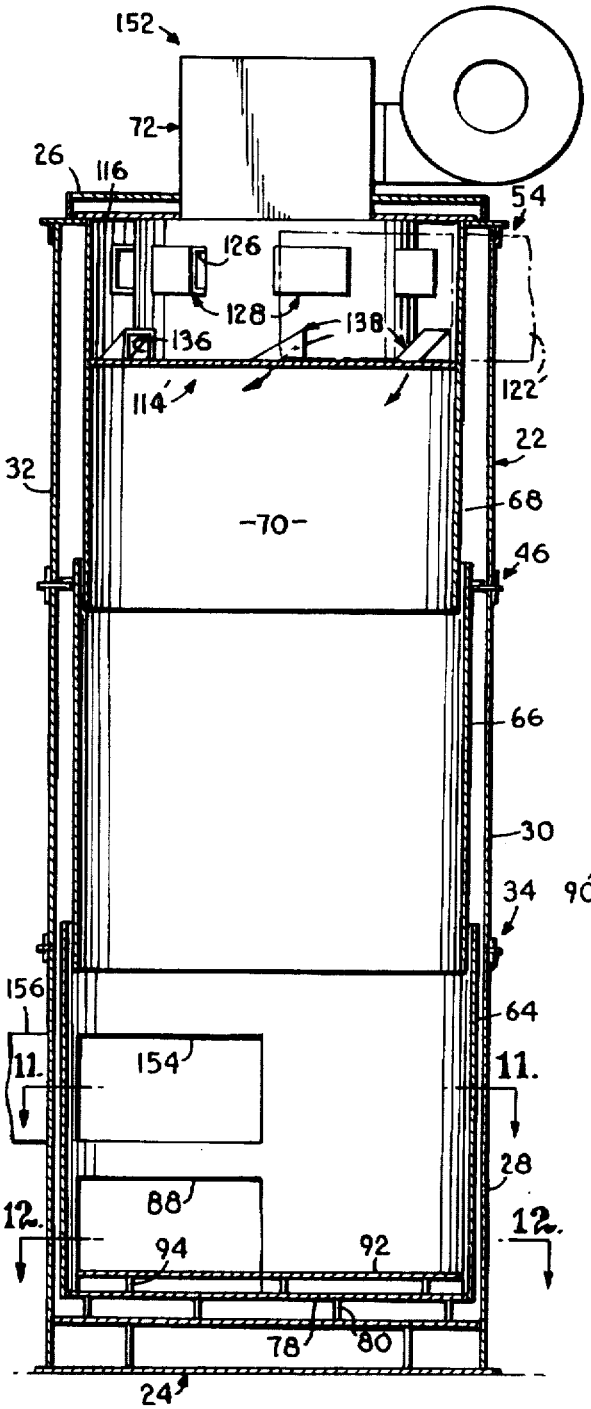
FIG. 10 is a detailed cross-sectional view of an alternative combustion chamber construction embodying the principles of this invention, parts being broken away and shown in cross-section to reveal details of construction.
Figure 11:
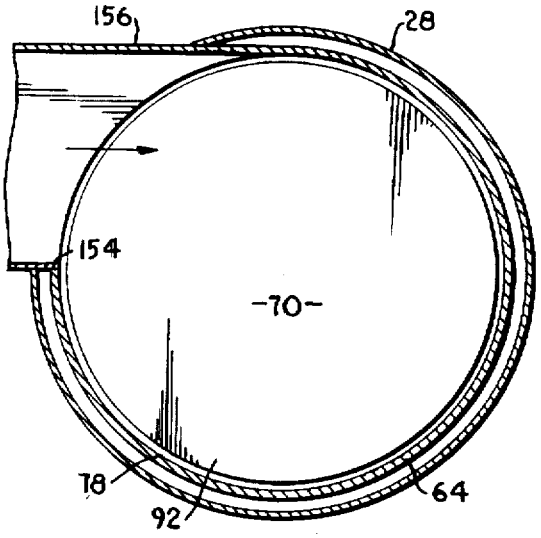
FIG. 11 is an enlarged detailed cross-sectional view taken generally along line 11—11 of FIG. 10 and showing an additional recycled gas input port.
Figure 12:
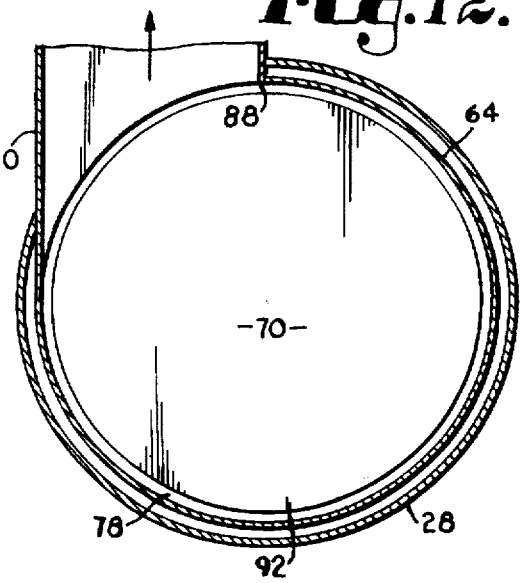
FIG. 12 is an enlarged detailed cross-sectional view taken generally along line 12—12 of FIG. 10 and showing the combustion chamber outlet port.

An alternative combustion chamber construction 152 is shown in FIGS. 10–12. Like reference numerals are used in FIGS. 10–12 to designate structures identical or similar to those described above and found in FIGS. 1–9. Chamber 52 differs from chamber 20 in that chamber 52 has a shorter insert 114 with less ports 128 and has an additional recycled gas inlet port 154. Combustion chamber 152 is for use in a drying system wherein there are multiple combustion chambers and dryers.

More particularly, multiple dryer systems often include a primary dryer wherein the moisture level of a material is first reduced to a particular level. Thereafter, the partially dried material is conveyed to a secondary dryer or dryers wherein the material is then fully dried. Typically, a majority of the harmful pollutants resulting from the drying process are generated in the primary dryer. In the secondary dryer or dryers, not as many pollutants are generated. Therefore, oftentimes it is advantageous to ensure that all of the gases separated from the material during the primary drying stage are completely oxidized.

Combustion chamber 152 typically is used in conjunction with a secondary dryer. More specifically, a portion of the gases coming from the primary dryer are conveyed to chamber 152 to be oxidized. The recycled gases coming from the primary dryer are introduced into chamber 152 via the inlet duct 122' and insert 114'.

Because it is not as crucial to get as complete an oxidation of recycled gases separated from a material dried in a secondary dryer, these gases typically are introduced into the combustion chamber 152 via inlet duct 156 and port 154.

Combustion chamber 152 operates in the same manner as combustion chamber 20 in that it has the same unique supporting structure for liners 64, 66 and 68 and further utilizes a swirling film of recycled gas generated by insert 114' to absorb thermal energy.

An alternative construction for annular insert 114 is shown in FIGS. 13 and 14. More specifically, inner surface 118 of the insert has a plurality of directional baffles 160 extending inwardly therefrom. Each baffle is associated with one of the openings 126, as best shown in FIG. 14. As depicted by the arrows in FIG. 14, baffles 160 help ensure that gases exiting the insert flow along and wipe the inner surface of the insert.

Annular plate 120 can also have a plurality of directional baffles 162 extending downwardly therefrom. Each baffle 162 is associated with one of the openings 136, as shown in FIG. 13. Baffles 162 aid the rotational motion of the gas film by ensuring that gases exiting openings 136 are directed laterally.

With reference to FIGS. 15–17, a temperature distribution plate 164 will be described. Plate 164 is positioned in liner section 64 so that it substantially covers outlet port 88 as best shown in FIG. 15. More specifically, plate 164 extends in a secant-like manner from a point on liner 64 that is adjacent but outside of one side of port 88 to a point on liner 64 that is adjacent but outside of the other side of port 88. Thus, as best shown in FIG. 16, plate 164 generally traverses the port laterally.

Plate 164 consists of a lower section 166 which is attached to and extends upwardly from the floor 78 of lower section 64. Lower section 166 has a plurality of spaced apertures 168 formed therein and extending laterally across its length. The upper edge of section 166 is folded to form a U-shaped elongated connecting trough 170. The lower edge of an upper plate section 172 is removably received in trough 170 so that the upper section can be removed if it is necessary to gain access to the interior of the combustion chamber via the outlet port 88. That is, upper section 172 can be easily removed from its position traversing the outlet port by simply lifting upwardly on plate 172 so that its lower edge is disengaged from trough 170.

Section 172 has a plurality of upwardly extending and generally trapezoidal-shaped teeth 174. Each tooth 174 is spaced from an adjacent tooth 174 so that a generally trapezoidal-shaped space 176 is formed between them. Section 172 also has a plurality of apertures 180 formed therein and extending across its length. Each aperture 180 is positioned generally along the center line of a tooth 174 and is positioned vertically so that the center of the aperture generally is aligned with the base of the tooth. Additionally, apertures 180 are vertically aligned with apertures 168 of lower section 166.

It has been found that plate 164 will better mix the gases exiting the combustion chamber and entering the outlet port so that the temperature gradient of the gases are more consistent. More specifically, it has been found that without plate 164 a temperature profile taken across port 88 can vary as much as ±200 degrees Fahrenheit. With plate 164 in place across port 88, the variation of the temperature profile can be reduced to ±50 degrees Fahrenheit. Thus, the provision of plate 164 will increase the temperature consistency of the flow of gases entering the dryer.

Although the above discussion has described the combustion chamber of this invention in connection with a drying system, as is apparent, the combustion chamber can be used in any system which requires a stream of heated gases to act upon a material. For instance, the combustion chamber described herein can be easily adopted to be used for the production of asphalt wherein the heated gas stream would be used to heat the asphalt mix.

I claim:

1. A combustion chamber adapted to receive secondary gases, the chamber comprising:

a vertically oriented body, said body including an outer shell and an inner liner with an inner surface defining an inner combustion area, said outer shell having a generally horizontal inwardly extending support shelf, said inner liner having an outwardly extending generally horizontal ridge positioned adjacent its upper end, said ridge resting on said shelf to support said liner in a hanging fashion so that said liner can expand and contract when subjected to temperature variations;

a burner disposed adjacent one end of said body so that the flame of said burner when lit will extend into said combustion area; and an annular insert disposed in said combustion area and generally surrounding the flame of said burner when lit, said annular insert defining a secondary gas introduction zone for introducing secondary gases into said combustion area so that the secondary gases can be oxidized by the burner flame, said insert having an inner surface presenting at least one opening for allowing fluid communication between said introduction zone and said combustion area, said opening disposed generally tangentially to said insert inner surface to direct said secondary gases in a rotational motion to define a film of gases adjacent said inner surface of said combustion chamber.

2. The combustion chamber of claim 1 wherein said shelf and said ridge are both generally annular in shape, said shelf having an inner edge that is spaced from an outer peripheral surface of said liner so that said liner can expand and contract laterally when subjected to temperature variations.

3. The combustion chamber of claim 1 wherein said body includes a second inner liner disposed below said first liner, said outer shell having a second generally horizontal inwardly extending support shelf disposed below said first shelf, said second liner having an outwardly extending generally horizontal ridge positioned adjacent its upper end, said second ridge resting on said second shelf to support said second liner in a hanging fashion so that said second liner can expand and contract when subjected to temperature variations, said first liner having a lower edge that is concentric with said second liner.

4. The combustion chamber of claim 3 wherein said body includes a bottom inner liner, said bottom liner having a floor resting on a base section of said outer shell and an upper edge, said upper edge disposed adjacent a lower edge of said second liner so that said second liner lower edge is concentric with said bottom liner.

5. The combustion chamber of claim 4 wherein said first liner, said second liner, and said bottom liner are all made of stainless steel.

6. The combustion chamber of claim 4 wherein said first, second and bottom liners have a cylindrical shape.

7. A combustion chamber comprising:

a vertically oriented outer shell, said outer shell having a generally horizontal inwardly extending support shelf;

an inner liner disposed inside of said outer shell and having an inner surface defining an inner combustion area, said inner liner having an outwardly extending generally horizontal ridge positioned adjacent its upper end, said ridge resting on said shelf to support said liner in a hanging fashion so that said liner can expand and contract when subjected to temperature variations; and a burner disposed adjacent one end of said outer shell so that the flame of said burner when lit will extend into said combustion area.

8. The combustion chamber of claim 7 wherein said shelf and said ridge are both generally annular in shape, said shelf having an inner edge that is spaced from an outer peripheral surface of said liner so that said liner can expand and contract laterally when subjected to temperature variations.

9. The combustion chamber of claim 7, said combustion chamber further comprising a second inner liner disposed below said first liner, said outer shell having a second generally horizontal inwardly extending support shelf positioned below said first shelf, said second liner having an outwardly extending generally horizontal ridge positioned adjacent its upper end, said second ridge resting on said second shelf to support said second liner in a hanging fashion so that said second liner can expand and contract when subjected to temperature variations, said first liner having a lower edge that is concentric with said second liner.

10. The combustion chamber of claim 9, said combustion chamber further comprising a bottom inner liner, said bottom liner having an upper edge and a floor resting on a base section of said outer shell, said upper edge disposed adjacent a lower edge of said second liner so that said second liner lower edge is concentric with said bottom liner.

11. The combustion chamber of claim 10 wherein said first liner, said second liner, and said bottom liner are all made of stainless steel.

12. The combustion chamber of claim 10 wherein said first, second and bottom liners have a cylindrical shape.

13. A combustion chamber comprising:

a vertically oriented body, said body having an inner surface defining an inner combustion area and an outlet port for conveying heated gases from said area;

a burner disposed adjacent one end of said body so that the flame of the burner when lit will extend into said combustion area; and a mixing plate disposed across said outlet port, said plate having a plurality of horizontally aligned spaced apart generally trapezoidal-shaped teeth extending upwardly from its top edge, said plate also presenting a plurality of spaced apart apertures below said teeth, wherein each of said apertures is vertically aligned with one of said teeth.

14. A combustion chamber for a drying system adapted to receive recycled gases that have been separated from a dried material, the chamber comprising:

a body having an inner surface defining an inner combustion area;

a burner disposed adjacent one end of said body so that the flame of said burner when lit will extend into said combustion area; and an annular insert disposed in said combustion area and generally surrounding the flame of said burner when lit, said annular insert defining a recycled gas introduction zone for introducing recycled gases into said combustion area so that the recycled gases can be oxidized by the burner flame, said insert having an inner wall presenting at least one port extending into said recycled gas introduction zone for allowing fluid communication between said introduction zone and said combustion area, said port defining an opening extending inwardly into said gas introduction zone to direct said recycled gases in a rotational motion to define a film of gases adjacent said inner surface of said combustion chamber.

15. The combustion chamber of claim 14 wherein said inner wall of said insert presents a plurality of ports spaced around said inner wall.

16. The combustion chamber of claim 14 wherein said port is formed by a directional plate that extends into said recycled gassed introduction zone from said inner wall, said directional plate being generally tangential to said inner wall such that gases flowing through said opening and along said plate will be directed generally tangential to said inner wall into said combustion area.

17. The combustion chamber of claim 16 wherein said port further includes a pair of generally triangular-shaped plates extending from said inner wall on opposite sides of said directional plate such that said directional plate, said triangular plates, and said inner wall defines said opening.

18. The combustion chamber of claim 14 wherein said annular insert has a cylindrical shape.

19. The combustion chamber of claim 14 wherein said film of gas rotates in the same direction as the burner flame.

20. A combustion chamber for a drying system adapted to receive recycled gases that have been separated from a dried material, the chamber comprising:

a body having an inner surface defining an inner combustion area;

a burner disposed adjacent one end of said body so that the flame of said burner when lit will extend into said combustion area; and an annular insert disposed in said combustion area and generally surrounding the flame of said burner when lit, said annular insert defining a recycled gas introduction zone for introducing recycled gases into said combustion area so that the recycled gases can be oxidized by the burner flame, said insert having an inner wall presenting at least one port extending into said recycled gas introduction zone for allowing fluid communication between said introduction zone and said combustion area, said port defining an opening extending inwardly into said recycled gas introduction zone for allowing fluid communication between said introduction zone and said combustion area, said port defining an opening extending inwardly into said gas introduction zone to direct said recycled gases in a rotational motion to define a film of gases adjacent said inner surface of said combustion chamber, said insert further having an end surface distal from said burner and substantially perpendicular to said inner wall, said end surface presenting at least one port extending into said recycled gas introduction zone, said end surface port defining an opening extending inwardly into said gas introduction zone so that recycled gases are further directed in a rotational motion to define a film of gases adjacent said inner surface of the combustion chamber.

* * * * *